US009064670B2

(12) United States Patent
Kim et al.

(10) Patent No.: US 9,064,670 B2
(45) Date of Patent: Jun. 23, 2015

(54) ELECTRON EMISSION DEVICE AND X-RAY GENERATOR INCLUDING THE SAME

(71) Applicant: Samsung Electronics Co., Ltd., Suwon-si (KR)

(72) Inventors: Il-hwan Kim, Seoul (KR); Do-yoon Kim, Hwaseong-si (KR); Yong-chul Kim, Seoul (KR); Shang-hyeun Park, Yongin-si (KR); Tae-won Jeong, Yongin-si (KR)

(73) Assignee: SAMSUNG ELECTRONICS CO., LTD. (KR)

( * ) Notice: Subject to any disclaimer, the term of this patent is extended or adjusted under 35 U.S.C. 154(b) by 144 days.

(21) Appl. No.: 13/771,736

(22) Filed: Feb. 20, 2013

(65) Prior Publication Data

US 2013/0230146 A1 Sep. 5, 2013

(30) Foreign Application Priority Data

Mar. 2, 2012 (KR) ..... 10-2012-0022033

(51) Int. Cl.

| | |
|---|---|
| ***H01J 35/06*** | (2006.01) |
| ***H05G 1/52*** | (2006.01) |
| ***H01J 29/02*** | (2006.01) |
| ***H01J 35/04*** | (2006.01) |
| ***H01J 3/02*** | (2006.01) |

(52) U.S. Cl.

CPC ..... *H01J 29/025* (2013.01); *H01J 35/045* (2013.01); *H01J 3/021* (2013.01); *H01J 2203/0216* (2013.01); *H01J 2203/0236* (2013.01); *H01J 2203/0244* (2013.01); *H01J 2203/0272* (2013.01); *H01J 35/065* (2013.01); *H01J 2235/068* (2013.01)

(58) Field of Classification Search

CPC ..... H01J 35/065; H01J 35/14; H01J 35/06; H01J 35/04; H05G 1/52; H05G 1/02

USPC ..... 378/91, 113, 119, 122, 134, 136, 138, 378/210; 250/396 R, 397, 423 R, 423 F, 250/493.1, 494.1, 503.1, 526; 313/399, 313/409, 414–417, 441, 446, 447, 452, 456, 313/457, 238, 243, 244, 252, 268, 292–302, 313/304, 310

See application file for complete search history.

(56) References Cited

U.S. PATENT DOCUMENTS

| | | | | |
|---|---|---|---|---|
| 5,363,021 | A * | 11/1994 | MacDonald | 315/366 |
| 5,754,014 | A * | 5/1998 | Kim et al. | 315/382.1 |
| 5,760,535 | A | 6/1998 | Moyer et al. | |
| 5,847,407 | A | 12/1998 | Lucero et al. | |
| 6,303,987 | B1 * | 10/2001 | Kawamura et al. | 257/686 |
| 6,899,584 | B2 | 5/2005 | Wilson | |

(Continued)

FOREIGN PATENT DOCUMENTS

| | | | |
|---|---|---|---|
| KR | 1995-0006909 | A | 3/1995 |
| KR | 100657844 | B1 | 12/2006 |

(Continued)

*Primary Examiner* — Anastasia Midkiff

(74) *Attorney, Agent, or Firm* — Cantor Colburn LLP

(57) ABSTRACT

An electron emission device includes a cathode electrode; a mesh-shaped gate electrode spaced apart from the cathode electrode; a plurality of gate spacers between the cathode electrode and the gate electrode; and a plurality of electron emission sources between the cathode electrode and the gate electrode, and alternating with the plurality of gate spacers.

17 Claims, 5 Drawing Sheets

(56) References Cited

U.S. PATENT DOCUMENTS

| | | | | |
|---|---|---|---|---|
| 7,233,101 | B2 * | 6/2007 | Jin | 313/309 |
| 2005/0280350 | A1 * | 12/2005 | Seon | 313/496 |
| 2008/0129177 | A1 * | 6/2008 | Wilson et al. | 313/309 |

FOREIGN PATENT DOCUMENTS

| | | | |
|---|---|---|---|
| KR | 1020080056341 | A | 6/2008 |
| KR | 1020090046274 | A | 5/2009 |
| KR | 1020110045938 | A | 5/2011 |

* cited by examiner

ELECTRON EMISSION DEVICE AND X-RAY GENERATOR INCLUDING THE SAME

CROSS-REFERENCE TO RELATED APPLICATIONS

This application claims priority to Korean Patent Application No. 10-2012-0022033, filed on Mar. 2, 2012, and all the benefits accruing therefrom under 35 U.S.C. §119, the disclosure of which is incorporated herein in its entirety by reference.

BACKGROUND

1. Field

Provided is an electron emission device using electric field emission and an X-ray generator including the same.

2. Description of the Related Art

X-rays are used in non-destructive testing, structural and physical properties testing, image diagnosis, security inspection and the like in the fields of industry, science, medical treatment, etc. Generally, a photographing apparatus using X-rays for such purposes includes an X-ray generator for radiating an X-ray and a detector for detecting an X-ray that s passed through an object.

Generally, the X-ray generator radiates an X-ray by colliding electrons emitted from a cathode, with an anode. An electron emission device that is used in the X-ray generator may be divided into a cold cathode and a hot cathode. An electron emission device using electric field emission may also be easily driven at a low voltage. Thus, much research is being conducted in order to commercialize the electron emission device using electric field emission.

SUMMARY

Provided is an electron emission device for preventing arcing by preventing an insulation material from being charged with electric charges.

Provided is an electron emission device in which a uniform electric field may be formed.

Additional aspects will be set forth in part in the description which follows and, in part, will be apparent from the description, or may be learned by practice of the presented embodiments.

According to an aspect of the present invention, an electron emission device includes: a cathode electrode; a mesh-shaped gate electrode spaced apart from the cathode electrode; a plurality of gate spacers between the cathode electrode and the gate electrode; and a plurality of electron emission sources between the cathode electrode and the gate electrode and alternating with the plurality of gate spacers.

A plurality of openings may be defined in the gate electrode and expose a portion of each electron emission source which is between adjacent gate spacers.

The mesh-shaped gate electrode may include: a plurality of gate lines respectively on the plurality of gate spacers; and a plurality of gate bridges which connect the plurality of gate lines to each other.

An interval between two adjacent gate bridges from among the plurality of gate bridges may be equal to or larger than a width of a gate bridge.

An interval between two adjacent gate bridges from among the plurality of gate bridges may be equal to or less than twice a distance between the electron emission sources and the gate electrode.

The plurality of gate spacers or the plurality of electron emission sources may be linear-shaped.

The electron emission device may further include a charging prevention film on the plurality of gate spacers. The charging prevention film prevents electrical charging of the plurality of gate spacers by electrons emitted by the plurality of electron emission sources.

The charging prevention film may be on lateral sides of the plurality of gate spacers and may be connected to the gate electrode.

The charging prevention film may be further on an upper side of each of the plurality of gate spacers. The charging prevention film may be further on an upper side of the cathode electrode.

A resistivity of the charging prevention film may be between a resistivity of the gate electrode and a resistivity of the plurality of gate spacers.

A resistivity of the charging prevention film may be in a range from about $10^7$ ohms centimeter (Ω cm) to about $10^{10}$Ω cm.

A cross-sectional width of each of the plurality of gate spacers may decrease in a direction from the cathode electrode to the gate electrode.

The electron emission device may further include: a focusing gate spaced apart from the gate electrode and focusing electrons emitted from the plurality of electron emission sources; and a focusing spacer between the gate electrode and the focusing gate.

The electron emission device may include a plurality of focusing gates including first and second focusing gates sequentially disposed spaced apart from the gate electrode, and a plurality of focusing spacers including first and second focusing spacers, where the first focusing gate is between the first and second focusing spacers.

A positive voltage may be applied to the first focusing gate and a negative voltage may be applied to the second focusing gate.

The cathode electrode, the plurality of gate spacers and the plurality of electron emission sources may be integrated, and the gate electrode may be detachable from and attachable to the plurality of gate spacers.

According to another aspect of the present invention, an X-ray generator includes: a container unit; the electron emission device as describe above in the container unit; and an anode which generates X-rays by using electrons emitted from the electron emission device.

The electron emission device may be detachable from and attachable to the container unit.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
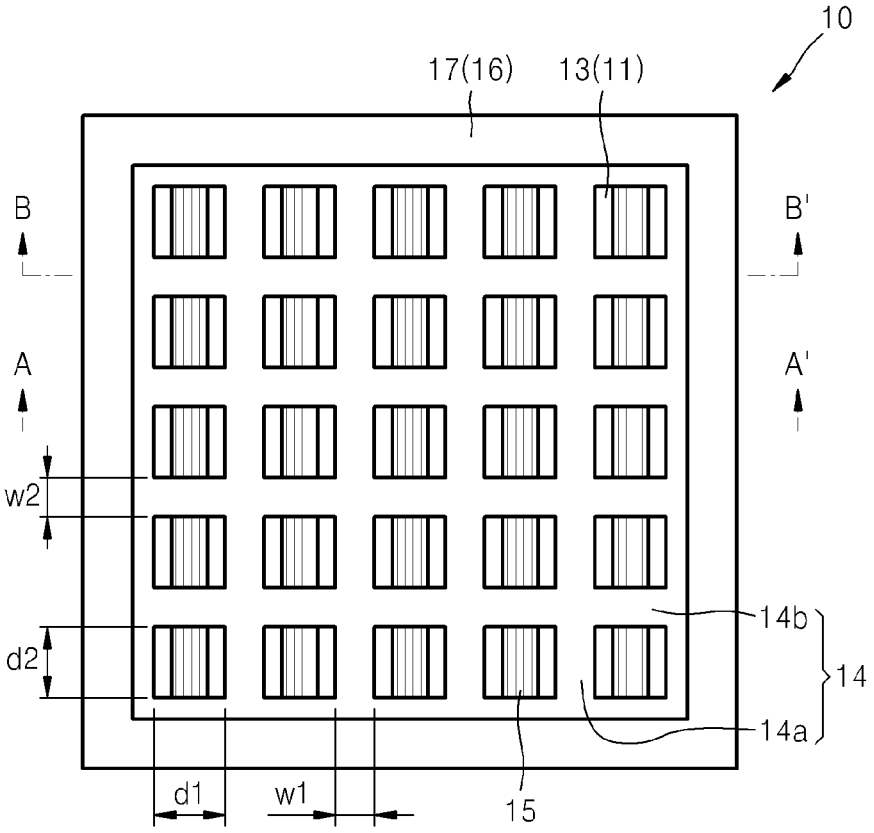
FIG. 1 is a plan view illustrating an embodiment of an electron emission device according to the present invention.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. Expressions such as "at least one of," when preceding a list of elements, modify the entire list of elements and do not modify the individual elements of the list.

It will be understood that when an element or layer is referred to as being "on" or "connected to" another element or layer, the element or layer can be directly on or connected to another element or layer or intervening elements or layers. In contrast, when an element is referred to as being "directly on" or "directly connected to" another element or layer, there are no intervening elements or layers present. As used herein, connected may refer to elements being physically and/or electrically connected to each other. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "lower," "under," "above," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "under" relative to other elements or features would then be oriented "above" relative to the other elements or features. Thus, the exemplary term "under" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used in this specification, specify the presence of stated features, integers, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the invention will be described in detail with reference to the accompanying drawings.

Figure 2A:
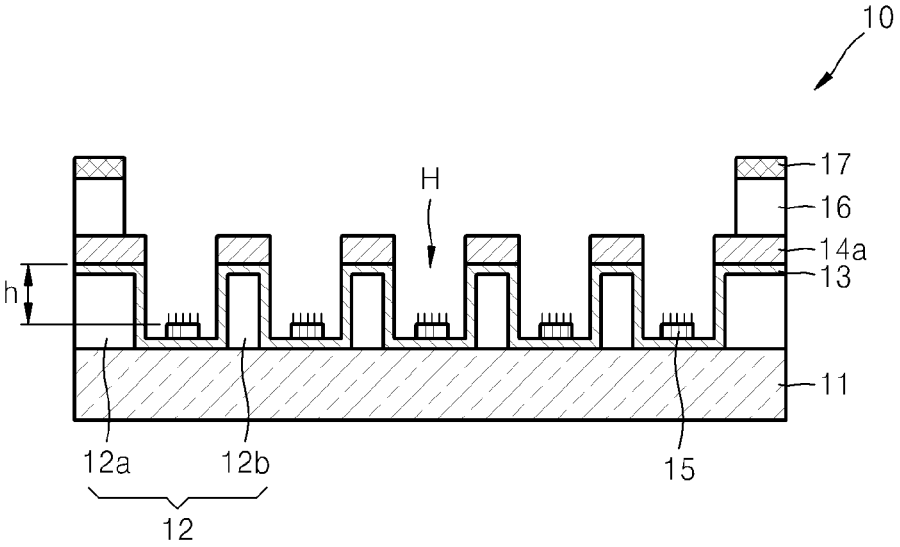
FIG. 2A is a cross-sectional view taken along line A-A' illustrated in FIG. 1.
Figure 2B:
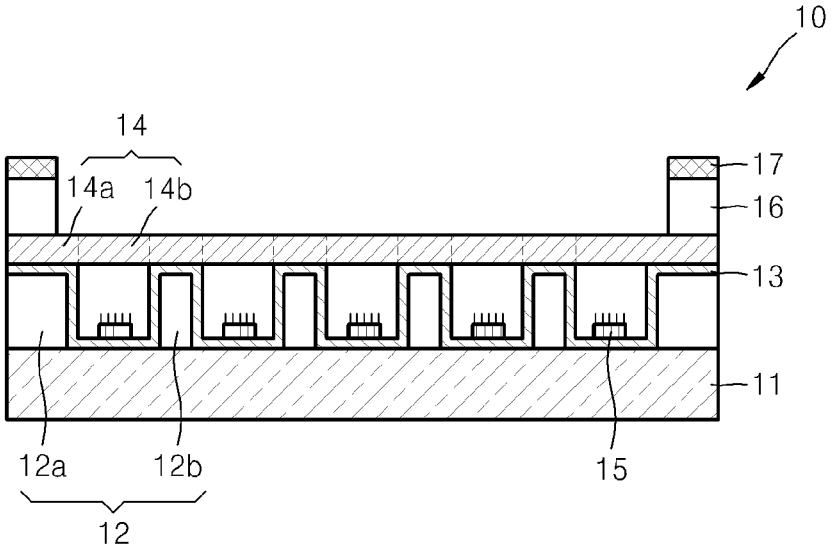
FIG. 2B is a cross-sectional view taken along line B-B' illustrated in FIG. 1.

FIG. 1 is a plan view illustrating an embodiment of an electron emission device 10 according to the present invention, FIG. 2A is a cross-sectional view taken along line A-A' illustrated in FIG. 1, and FIG. 2B is a cross-sectional view taken along line B-B' illustrated in FIG. 1.

Referring to FIGS. 1, 2A, and 2B, the electron emission device 10 includes a cathode electrode 11, a gate electrode 14 that is disposed spaced apart from the cathode electrode 11 in a cross-sectional direction and has a mesh structure in a plan view, a plurality of gate spacers 12 that extend in a first direction between the cathode electrode 11 and the gate electrode 14 and are disposed spaced apart from each other in a second direction different from the first direction, and a plurality of electron emission sources 15. The first direction may be an up-down direction in FIG. 1 while the second direction may be a left-right direction in FIG. 1.

The cathode electrode 11 and the gate electrode 14 may include a conductive material, such as a metal, a conductive metal oxide, or the like. In one embodiment, for example, the cathode electrode 11 and the gate electrode 14 may include a metal such as Ti, Pt, Ru, Au, Ag, Mo, Al, W, or Cu, or may include a metal oxide such as indium tin oxide ("ITO"), aluminum zinc oxide ("AZO"), indium zinc oxide ("IZO"), tin oxide ($SnO_2$) or $In_2O_3$.

The cathode electrode 11 applies a voltage to the electron emission sources 15, and may have a substantially planar shape. The gate electrode 14 receives a voltage having a different level from a voltage that is applied to the cathode electrode 11, and induces electron emission of the electron emission sources 15.

The gate electrode 14 may have a mesh structure in the plan view, and a plurality of openings H may be defined in the gate electrode 14. In one embodiment, or example, the gate electrode 14 may include a plurality of gate lines 14*a* on and overlapping the gate spacers 12. The gate lines 14*a* have a longitudinal axis which extends in the first direction, and are spaced apart from each other in the second direction. The gate electrode 14 may further include a plurality of gate bridges 14*b* that connect the plurality of gate lines 14*a* to each other.

The plurality of gate bridges 14*b* has a longitudinal axis which extends in the second direction, and the gate bridges 14*b* are spaced apart from each other in the first direction. Thus, the openings H may be defined by using two adjacent gate lines 14*a* and two adjacent gate bridges 14*b*. The openings H may be disposed so that at least a portion of each of the electron emission sources 15 is exposed between the gate spacers 12.

The width $w_1$ of the gate lines 14*a* may be equal to or different from the width $w_2$ of the gate bridges 14*b*. In addition, an interval $d_1$ between the gate lines 14*a* may be equal to or different from an interval $d_2$ between the gate bridges 14*b*. In one exemplary embodiment, for example, the interval $d_2$ between the gate bridges 14*b* may be equal to or larger than the width $w_2$ of the gate bridges 14*b*, and the interval $d_2$ between the gate bridges 14*b* may be equal to or less than twice a distance h between the electron emission sources 15 and the gate electrode 14. If the interval $d_2$ between the gate bridges 14*b* is more than twice the distance h between the electron emission sources 15 and the gate electrode 14, non-uniformity of an electric field that is formed in the electron emission sources 15 increases. That is, a larger electric field is formed under the gate bridges 14*b*, and thus, electron emission from the electron emission sources 15 becomes non-uniform.

The electron emission device 10 having a relatively large planar area may be manufactured since the gate electrode 14 has the mesh structure as stated above. Although, in FIG. 1, the planar shape of the openings H of the gate electrode 14 is a quadrangle, the present invention is not limited thereto. The shape of the openings H may be at least one from among a circle, an oval and a polygon. The planar sizes or dimensions of the openings H may be equal to each other, or alternatively, may be different from each other.

The gate spacers 12 are disposed between the cathode electrode 11 and the gate electrode 14 and reduce or effectively prevent an electrical current from flowing between the cathode electrode 11 and the gate electrode 14. In addition, the number of gate spacers 12 may be more than three. The gate spacers 12 may have a substantially linear shape in the plan view. Thus, the gate spacers 12 extend in a predetermined direction and are disposed spaced apart from each other in another predetermined direction to support the gate electrode 14 thereon. In one embodiment, the gate spacers 12 have a longitudinal axis which extends in the first direction and are spaced apart from each other in the second direction. The gate spacers 12 may include a first gate spacer 12*a* for supporting an edge area of the gate electrode 14 and a second gate spacer 12*b* for supporting a non-edge area of the gate electrode 14 between the edge areas and at a center.

An interval between the gate spacers 12 in the second direction may be equal to or larger than an interval between the gate lines 14*a* in the same second direction. The gate spacers 12 may include an insulation material that is used in a semiconductor device, e.g., the electron emission device 10. In one embodiment, for example, the gate spacers 12 may include $SiO_2$, or may include $HfO_2$, $Al_2O_3$, $Si_3N_4$, or a compound thereof, which are high-K materials having high permittivity compared to $SiO_2$.

Although, the gate spacers 12 having a linear shape are illustrated in FIGS. 2A and 2B, the present invention is not limited thereto. The gate spacers 12 may have a different planar shape so long as such different shape reduces or effectively prevents an electrical current from flowing between the cathode electrode 11 and the gate electrode 14 and supports the gate electrode 14. In one embodiment, for example, the second gate spacer 12*b* may have a pillar shape that is disposed under the gate line 14*a*, but is not limited thereto or thereby. As the pillar shape, a cross-sectional width may be substantially constant in a direction from the cathode electrode 11 to the gate electrode 14.

The electron emission sources 15 emit electrons due to a voltage that is applied to the cathode electrode 11 and the gate electrode 14. The electron emission device 10 may include the plurality of electron emission sources 15 as stated above, and the plurality of electron emission sources 15 may be alternately disposed with the plurality of gate spacers 12. In one embodiment, for example, the plurality of electron emission sources 15 may be disposed spaced apart from each other while placing the second gate spacer 12*b* between them. The electron emission sources 15 may have a stripe shape extending in the first direction like the second gate spacer 12*b*. That is, the electron emission sources 15 may be elongated in the first direction, and be spaced apart from each other in the second direction. While the electron emission sources 15 are exposed by the holes H, they are overlapped by the gate bridges 14*b*. Since the gate electrode 14 has the mesh structure, the gate electrode 14 is disposed also over the electron emission sources 15. Thus, the electron emission sources 15 may be disposed spaced apart from the gate electrode 14 in the cross-sectional direction so that the electron emission sources 15 and the gate electrode 14 are not electrically shorted.

The electron emission sources 15 may include a material that may emit electrons. In one embodiment, for example, the electron emission sources 15 may include metal, silicon, oxide, diamond, diamond like carbon ("DLC"), carbide compound, nitride, carbon nanotube, carbon nanofiber or the like.

In one embodiment, the cathode electrode 11, the plurality of gate spacers 12 and the plurality of electron emission sources 15 are integrated, such as non-removable or non-detachable with respect to each other after being attached to each other, and the gate electrode is detachable from and attachable to the plurality of gate spacers 12. However, the present invention is not limited thereto or thereby.

The electron emission device 10 may emit more electrons as the area of the electron emission sources 15 is larger in the electron emission device 10. However, the electron emission device 10 has to endure an electrostatic force due to a voltage difference that is applied between the electron emission sources 15 and the gate electrode 14. Thus, by alternately disposing the gate spacers 12 and the electron emission sources 15, and by disposing the gate electrode 14 with the openings H defined therein over areas where the electron emission sources 15 are disposed, the electron emission device 10 having the relatively large planar area may be implemented. In addition, since the gate electrode 14 includes the gate bridges 14*b* that are disposed in a direction intersecting with a length direction of the electron emission sources 15, a uniform electric field may be formed on the surface of the electron emission sources 15.

In addition, since the electron emission sources 15 are disposed also under and overlapping the gate bridges 14*b*, it is necessary to minimize electrons that are emitted under the gate bridges 14*b*. Thus, the interval $d_2$ between the gate bridges 14*b* may be larger than the width $w_2$ of the gate bridges 14*b*. The interval $d_2$ between the gate bridges 14*b* may be equal to or less than twice the distance h between the electron emission sources 15 and the gate electrode 14.

The electron emission device 10 may further include a focusing gate 17 which is disposed spaced apart from the gate electrode 14 in the cross-sectional direction and focuses electrons, and a focusing spacer 16 that is disposed between the gate electrode 14 and the focusing gate 17 and prevents an electrical short circuit between the gate electrode 14 and the focusing gate 17. The focusing gate 17 and the focusing spacer 16 may have a planar shape of a ring or frame whose center area is empty as not including any material of the focusing gate 17 and focusing spacer 16. An opening at the center area may be considered defined in the focusing gate 17 and the focusing spacer 16. Thus, electrons passing through the center area of the focusing gate 17 are focused. A voltage that is applied to the focusing gate 17 is equal to or similar to a voltage that is applied to the gate electrode 14, and thus, an optimum focusing performance may be maintained.

If a voltage is applied between the cathode electrode 11 and the gate electrode 14, electrons are emitted from the electron emission sources 15 due to a potential difference. The emitted electrons may be discharged to the outside of the electron emission device 10 through the openings H of the gate electrode 14, but may collide with the gate spacers 12. In addition, some of electrons proceeding to the gate electrode 14 that do not collide with the gate spacers 12 after the emission of electrons may collide with the gate electrode 14 and then proceed to the gate spacers 12 again. Electrons colliding with the gate spacers 12 accumulate charges on the surface of the gate spacers 12, and a discharge may occur if charges accumulate over a predetermined level. The electron emission from the gate spacers 12 may generate arcing and thus deteriorate the performance of the electron emission device 10.

Thus, the electron emission device 10 may further include a charging prevention film 13 that is disposed on the gate spacers 12 and reduces or effectively prevents the gate spacers 12 from being electrically charged by electrons generated in the electron emission sources 15. The charging prevention film 13 may be disposed to cover the gate spacers 12, such as to overlap both side and upper surfaces of the gate spacers 12. The charging prevention film 13 may also be disposed on a portion of the cathode electrode 11 which is exposed between the gate spacers 12, as well as on the gate spacers 12 themselves. The charging prevention film 13 may be a single, unitary, indivisible member, but is not limited thereto or thereby. The electron emission sources 15 may be disposed on the charging prevention film 13 which overlaps the exposed portion of the cathode electrode 11. A thickness of the charging prevention film 13 may be less than about 500 angstroms (Å), where the thickness is taken in a direction normal to the respective surface which it covers.

The charging prevention film 13 may include a material having a resistivity value between the resistivity of the gate spacers 12 and the resistivity of the gate electrode 14. The resistivity value "ρ" may be determined depending on the thickness "t" of the charging prevention film 13, and the amount "I" of leakage current between the cathode electrode 11 and the gate electrode 14, which is permitted by the electron emission device 10, and may be calculated from Ohm's law such as the following Equation (1).

$$I=V/R=V/(\rho*l/t) \quad (1)$$

"V" indicates a voltage between the cathode electrode 11 and the gate electrode 14, and "l" indicates a length of a portion of the charging prevention film 13, which connects the cathode electrode 11 and the gate electrode 14. For example, the resistivity of the charging prevention film 13 may be in the range of about $10^7$ ohms centimeter (Ω cm) to about $10^{10}$Ω cm. The charging prevention film 13 may include a-Si, $Cr_2O_3$, TaN, $RuO_2$, PbO, NiCr, $Bi_2Ru_2O_7$ or the like.

Generally, electrons that are emitted from the electron emission sources 15 are discharged to the outside of the electron emission device 10 through the openings H of the gate electrode 14. However, some of electrons that are emitted from the electron emission sources 15 may be incident on the charging prevention film 13. Since the resistivity of the charging prevention film 13 is smaller than that of the gate spacers 12 and larger than that of the gate electrode 14, electrons incident on the charging prevention film 13 move to the gate electrode 14 having a relatively high potential. Thus, charging of the gate spacers 12 with electric charges may be reduced or effectively prevented, and arcing may be reduced. In this manner, since the charging prevention film 13 is disposed between the electron emission sources 15 and the gate spacers 12, charging of the gate spacers 12 with electric charges may be reduced or effectively prevented.

In manufacturing the electron emission device 10, the gate electrode 14, the gate spacers 12 and the charging prevention film 13 may be formed by deposition and patterning. In one embodiment, for example, a conductive material is deposited on a substrate to form the gate electrode 14, and an insulation layer used in forming the gate spacers 12 is sequentially formed. Next, the gate spacers 12 are formed by patterning the insulation layer. Next, the gate electrode 14 may be formed by using a mask, after forming the charging prevention film 13 on the gate spacers 12 and an exposed portion of the cathode electrode 11 between the gate spacers 12, to cover the gate spacers 12.

In addition, electron emission sources 15 may be formed by directly forming metal, silicon, oxide, diamond, DLC, carbide compound, nitride, carbon nanotube, carbon nanofiber or the like on the cathode electrode 11, such as by using a catalyst metal. Alternatively, the electron emission sources 15 may be formed by mixing a powder of a previously grown diamond, DLC, carbon nanotube, carbon nanofiber, or the like with paste together with a binder and then using screen printing or a photosensitive method.

The gate electrode 14, the focusing gate 17 and the focusing spacer 16 may be formed by assembly, as opposed to using a deposition and/or patterning process, but the invention is not limited thereto or thereby. The electron emission device 10 may be manufactured by sequentially disposing and combining the gate electrode 14, the focusing spacer 16 and the focusing gate 17 on a substrate including the cathode electrode 11, the gate spacers 12, the charging prevention film 13 and the electron emission sources 15 integrated thereon. In this manner, since assembly of the gate electrode 14, the focusing gate 17 and the focusing spacer 16 is performed after individually manufacturing the cathode electrode 11, the gate spacers 12 and the charging prevention film 13, replacing a defective element becomes relatively easy if any one of elements of the electron emission device 10 is defective.

The charging prevention film 13 does not need to cover an entire of the gate spacers 12. Although, in FIG. 1, the charging prevention film 13 is disposed on all surfaces of the gate spacers 12 and on the exposed portion of the cathode electrode 11 between the gate spacers 12, the present invention is not limited thereto. That is, the charging prevention film 13 may be disposed anywhere relative to the elements of the electron emission device 10 to reduce or effectively prevent electrons emitted from the electron emission sources 15 from colliding with the gate spacers 12.

Figure 3:
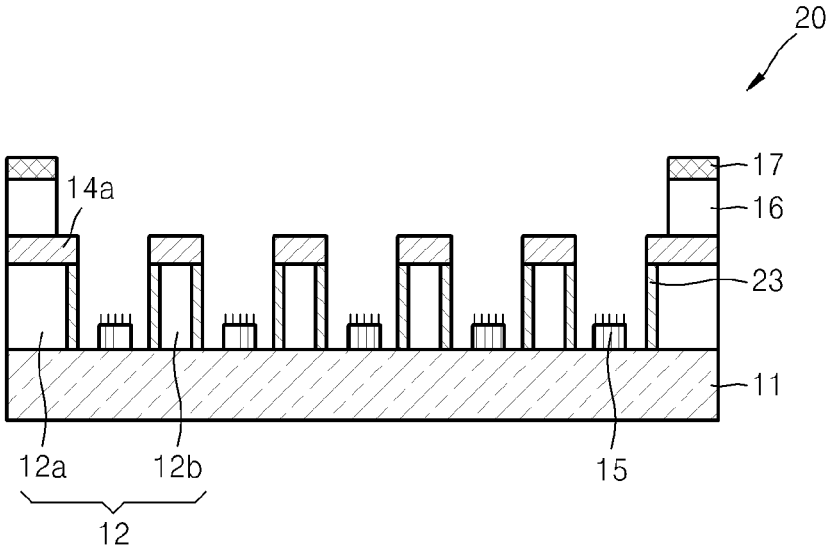
FIG. 3 is a cross-sectional view illustrating another embodiment of an electron emission device according to the present invention.

FIG. 3 is a cross-sectional view illustrating another embodiment of an electron emission device 20 according to the present invention. As illustrated in FIG. 3, a charging prevention film 23 of the electron emission device 20 may be disposed at the lateral sides of gate spacers 12. Since there is a high probability that electrons emitted from electron emission sources 15 collide with the lateral sides of the gate spacers 12, the charging prevention film 23 may be disposed only at the lateral sides of the gate spacers 12 to minimize a leakage current of a gate electrode 14 and a cathode electrode 11. The charging prevention film 23 may contact the gate electrode 14 so that electric charges of the charging prevention film 23 move to the gate electrode 14. In an embodiment of manufacturing the electron emission device 20, the charging prevention film 23 may be formed by using a photolithography process.

In addition, in order to minimize collisions between electrons emitted from the electron emission sources 15 and the charging prevention film 23, the charging prevention film 23 and/or the gate spacers 12 may be disposed aslope (e.g., inclined) with respect to the electron emission sources 15.

Figure 4:
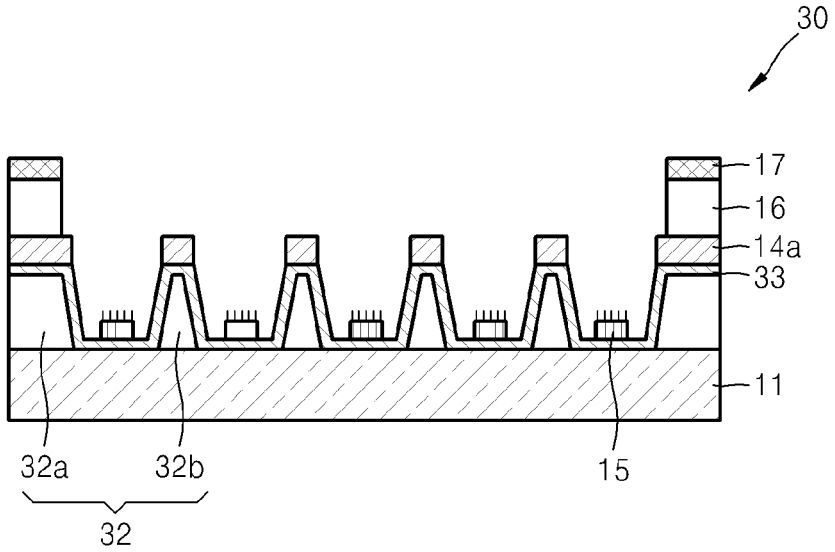
FIG. 4 is a cross-sectional view illustrating another embodiment of an electron emission device according to the present invention.

FIG. 4 is a cross-sectional view illustrating another embodiment of an electron emission device 30 according to the present invention. As illustrated in FIG. 4, the cross-sectional width of each gate spacer 32 may be smaller in a direction from a cathode electrode 11 to a gate electrode 14. Since the cross-sectional width of each gate spacer 32 decreases in the direction from the cathode electrode 11 to the gate electrode 14, a charging prevention film 33 that is disposed on the surfaces of the gate spacers 32 is disposed aslope with respect to electron emission sources 15. In the direction from a cathode electrode 11 to a gate electrode 14, a distance between the charging prevention film 33 and the electron emission source 15 increases. Thus, a probability that electrons emitted from electron emission sources 15 collide with a charging prevention film 33 is lowered.

Figure 5:
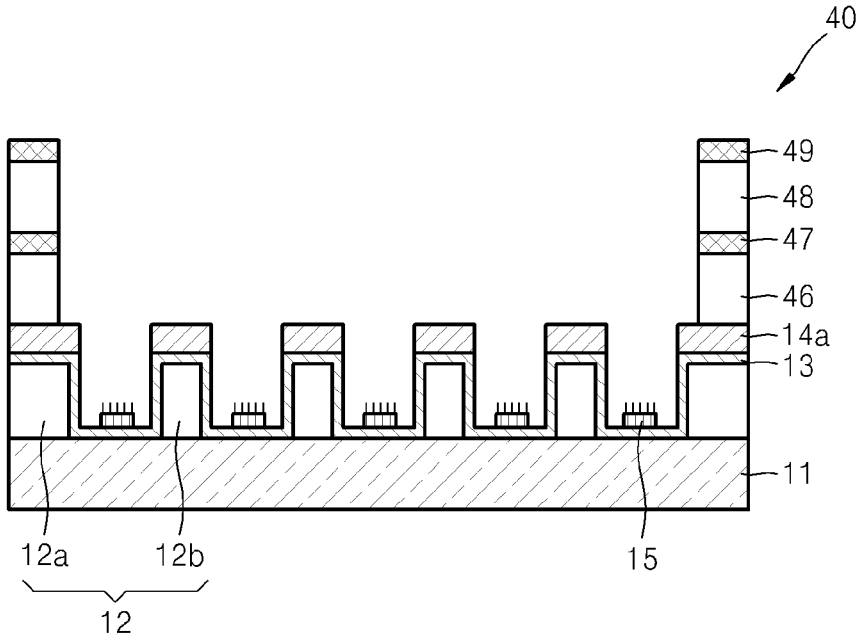
FIG. 5 is a cross-sectional view illustrating another embodiment of an electron emission device according to the present invention.

In addition, the electron emission device 30 may more effectively focus electrons by using a plurality of focusing gates as shown in FIG. 5.

FIG. 5 is a cross-sectional view illustrating another embodiment of an electron emission device 40 according to the present invention. As illustrated in FIG. 5, the electron emission device 40 may include two focusing gates 47 and 49 and two focusing spacers 46 and 48. In one embodiment, for example, the electron emission device 40 may include a first focusing spacer 46, a first focusing gate 47, a second focusing spacer 48 and a second focusing gate 49, which are sequentially disposed on the gate electrode 14. If a positive voltage is applied to the first focusing gate 47 and a negative voltage is applied to the second focusing gate 49, electrons emitted from electron emission sources 15 may be more effectively focused.

Figure 6:
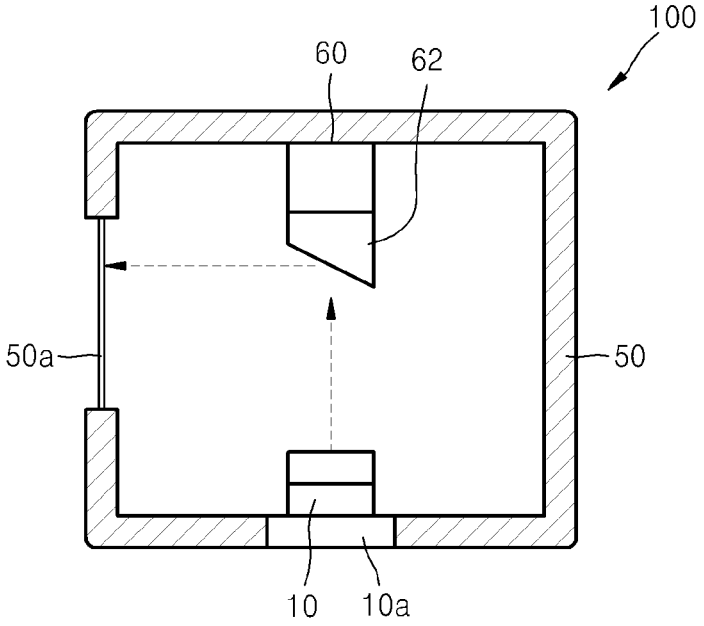
FIG. 6 is a diagram illustrating an embodiment of an X-ray generator including an electron emission device, according to the present invention.

FIG. 6 is a diagram illustrating an embodiment of an X-ray generator 100 including an electron emission device 10, according to the present invention.

Referring to FIG. 6, the X-ray generator 100 includes a container unit 50, the electron emission device 10 installed in the container unit 50, and an anode 60 for converting electrons emitted from the electron emission device 10 into X-rays. A window 50*a* that may output the X-rays to the outside of the container unit 50 is disposed at one side of the container unit 50. The electron emission devices 20, 30 and 40 illustrated in FIGS. 3 through 5 as well as the electron emission device 10 illustrated in FIG. 1 may be applied to the X-ray generator 100 of FIG. 6.

The shape of the container unit 50 is not limited to that of the illustrated embodiment. The container unit 50 may be shut tightly to maintain a vacuum state thereinside, and may further include an exhaust portion (not shown) connected to an external vacuum pump to exhaust internal gas to the outside of the container unit 50. The container unit 50 may include a material that blocks X-rays, for example, steel use stainless ("SUS"), glass, or the like. When the container unit 50 includes glass, the container unit 50 may further include an X-ray shield material that additionally blocks the X-rays, and, for example, may further include Pb or a heavy metal material. The window 50*a* may include an X-ray transmission material to discharge the X-rays to the outside of the container unit 50 while maintaining a vacuum state of the inside of the container unit 50, and, for example, may include Pyrex® glass, Al, or the like.

The electron emission device 10 may be the electron emission device 10 of FIG. 1, and may be disposed on a fixing portion 10*a*. The fixing portion 10*a* on which the electron emission device 10 is installed may be detachable from and attachable to the container unit 50.

The anode 60 generates an X-ray by using an electron beam generated from the electron emission device 10 and includes a target 62 including a metal such as Mo, Ag, W, Cr, Fe, Co, Cu, or the like or a metal alloy. The electron emission device 10 and the anode 60 may be connected to an external power supplier (not shown).

Figure 7:
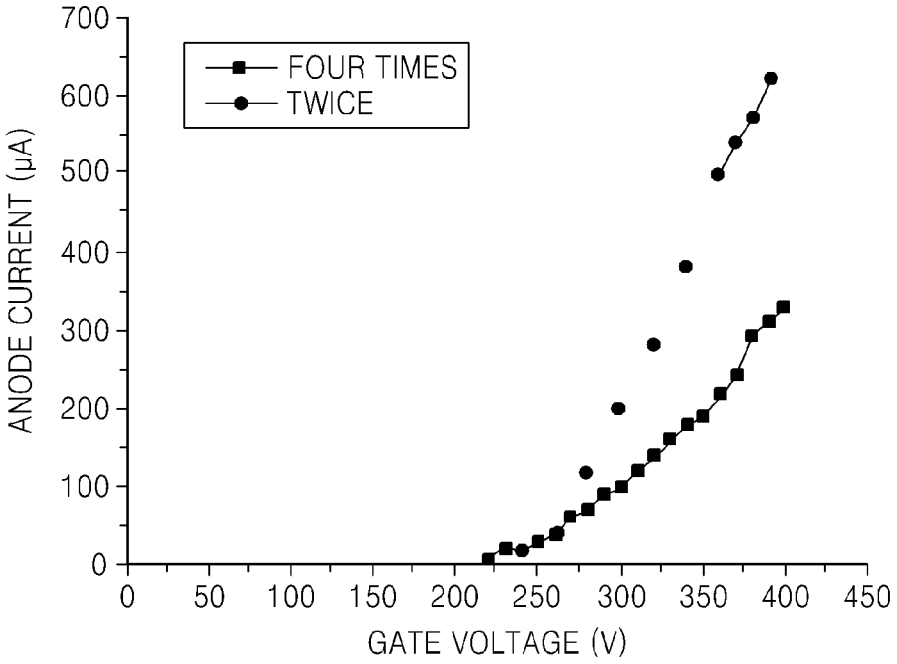
FIG. 7 is a diagram illustrating results of an experiment regarding a relationship between an interval between gate bridges and a current in microamps (μA) flowing through an anode, depending on a gate voltage in volts (V), according to the present invention.

FIG. 7 is a diagram illustrating a result of an experiment regarding a relationship between an interval $d_2$ between the gate bridges 14*b* and an electrical current in microamps (μA) flowing through the anode 60, according to the present invention. With the interval $d_2$ between the gate bridges 14*b* as twice the distance h between the electron emission sources 15 and the gate electrode 14, an electrical current flowing through the anode 60 depending on a gate voltage in volts (V) was measured. In addition, with the interval $d_2$ between the gate bridges 14*b* as four times the distance h between the electron emission sources 15 and the gate electrode 14, an electrical current flowing through the anode 60 depending on a gate voltage was measured.

As illustrated in FIG. 7, when the same gate voltage is applied, an electrical current flowing through the anode 60 when the interval $d_2$ is twice the distance h (TWICE), is larger than that flowing through the anode 60 when the interval $d_2$ is four times the distance h (FOUR TIMES). This means that electron emission efficiency is higher when the interval $d_2$ is twice the distance h, compared to when the interval $d_2$ is four times the distance h.

One or more embodiment of the electron emission device according to the present invention may reduce or effectively prevent a loss thereof due to arcing since a film for preventing gate spacers from being electrically charged is disposed on the gate spacers. In addition, a uniform electric field may be formed since the gate electrode of the electron emission device has a mesh structure.

While the present invention has been particularly shown and described with reference to embodiments thereof, it will be understood by those of ordinary skill in the art that various changes in form and details may be made therein without departing from the spirit and scope of the present invention as defined by the following claims.

What is claimed is:

1. An electron emission device comprising:

a cathode electrode;

a gate electrode spaced apart from the cathode electrode, and a plurality of openings defined in the gate electrode;

a plurality of gate spacers spaced apart from the gate electrode, between the cathode electrode and the gate electrode; and a plurality of electron emission sources between the cathode electrode and the gate electrode, and alternating with the plurality of gate spacers, wherein a first portion of each electron emission source is exposed by an opening among the plurality of openings defined in the gate electrode, and a second portion of each electron emission source is overlapped by the gate electrode.

2. The electron emission device of claim 1, wherein the gate electrode comprises:

a plurality of gate lines respectively on the plurality of gate spacers; and a plurality of gate bridges which connects the plurality of gate lines to each other.

3. The electron emission device of claim 2, wherein an interval between two adjacent gate bridges from among the plurality of gate bridges is equal to or greater than a width of a gate bridge.

4. The electron emission device of claim 2, wherein an interval between two adjacent gate bridges from among the plurality of gate bridges is equal to or less than twice a distance between the plurality of electron emission sources and the gate electrode.

5. The electron emission device of claim 1, wherein each of the plurality of gate spacers or each of the plurality of electron emission sources is linear-shaped.

6. The electron emission device of claim 1, further comprising a charging prevention film on the plurality of gate spacers, wherein the charging prevention film prevents electrical charging of the plurality of gate spacers by electrons emitted from the plurality of electron emission sources.

7. The electron emission device of claim 6, wherein the charging prevention film is on lateral sides of the plurality of gate spacers and is connected to the gate electrode.

8. The electron emission device of claim 7, wherein the charging prevention film is further on at least one of an upper side of each gate spacer and an upper side of a portion of the cathode electrode which is exposed between adjacent gate spacers.

9. The electron emission device of claim 6, wherein a resistivity of the charging prevention film is between a resistivity of the gate electrode and a resistivity of the plurality of gate spacers.

10. The electron emission device of claim 6, wherein a resistivity of the charging prevention film is in a range from about $10^7\Omega$ cm to about $10^{10}\Omega$ cm.

11. The electron emission device of claim 1, wherein a cross-sectional width of each gate spacer decreases in a direction from the cathode electrode to the gate electrode.

12. The electron emission device of claim 1, further comprising:

a focusing gate spaced apart from the gate electrode, wherein the focusing gate focuses electrons emitted from the plurality of electron emission sources; and a focusing spacer between the gate electrode and the focusing gate.

13. The electron emission device of claim 12, further comprising:

a plurality of focusing gates comprising first and second focusing gates sequentially disposed and spaced apart from the gate electrode, and a plurality of focusing spacers comprising first and second focusing spacers, wherein the first focusing gate is disposed between the first and second focusing spacers.

14. The electron emission device of claim 13, wherein the first focusing gate is applied with a positive voltage and the second focusing gate is applied with a negative voltage.

15. The electron emission device of claim 1, wherein the cathode electrode, the plurality of gate spacers and the plurality of electron emission sources are integrated, and the gate electrode is detachable from and attachable to the plurality of gate spacers.

16. An X-ray generator comprising:

a container unit;

the electron emission device of claim 1 in the container unit; and an anode which generates X-rays by using electrons emitted from the plurality of electron emission devices.

17. The X-ray generator of claim 16, wherein the electron emission device is detachable from and attachable to the container unit.

* * * * *